United States Patent [19]

Romance

[11] 4,263,499

[45] Apr. 21, 1981

[54] IMMERSION HEATER WITH THERMAL CUTOFF

[76] Inventor: Joseph S. Romance, 2867 Shadow Canyon Dr., Diamond Bar, Calif. 91765

[21] Appl. No.: 23,844

[22] Filed: Mar. 26, 1979

[51] Int. Cl.[3] ..... H05B 3/06

[52] U.S. Cl. ..... 219/331; 219/333; 219/336

[58] Field of Search ..... 219/320, 321, 324, 335, 219/336, 337, 517, 523, 331, 437

[56] References Cited

U.S. PATENT DOCUMENTS

| | | | |
|---|---|---|---|
| 2,576,688 | 11/1951 | Landgraf | 219/337 |
| 2,849,589 | 8/1958 | Lancaster | 219/517 |
| 2,888,547 | 5/1959 | Saper | 219/331 |
| 3,278,395 | 10/1966 | Rubinowitz | 219/331 |
| 3,310,657 | 3/1967 | Santoro, Jr. | 219/517 |
| 3,450,860 | 6/1969 | Kneisley | 219/331 |
| 3,673,386 | 6/1972 | Drugmano et al. | 219/523 |

FOREIGN PATENT DOCUMENTS

| | | | |
|---|---|---|---|
| 479859 | 2/1938 | United Kingdom | 219/331 |
| 606226 | 8/1948 | United Kingdom | 219/331 |
| 1278121 | 6/1972 | United Kingdom | 219/336 |

*Primary Examiner*—B. A. Reynolds
*Assistant Examiner*—Bernard Roskoski
*Attorney, Agent, or Firm*—Gene W. Arant; John T. Matlago

[57] ABSTRACT

An electric immersion heater comprises a plurality of U-shaped heater sheaths having the terminal leads of the coils in the legs thereof extending up into a junction box from which the sheaths depend. The immersion heater is provided with a centrally disposed metal tube having the top thereof extending into the junction box and the bottom thereof contacting a metal support plate used to hold the legs of the U-shaped heater sheaths in spaced relation. The support plate is located at the level of the upper ends of the coils in the sheaths. A replaceable cylindrical cartridge is provided which encapsulates a one-shot thermal cutoff. The portion of the end lead terminals of the thermal cutoff extending above the upper end of the cartridge are twisted together and sufficiently stiff and long enough to enable the cartridge to be inserted into the tube so as to be seated therein. Quick connectors located in the junction box are used to join the lead terminals of the coils and the thermal cutoff in a circuit with the terminals of the power lines.

9 Claims, 8 Drawing Figures

IMMERSION HEATER WITH THERMAL CUTOFF

BACKGROUND OF THE INVENTION

This invention relates to electric immersion heaters and more particularly to such a heater adapted to have a replaceable thermal cutoff mounted thereon.

Electric immersion heaters are used for heating corrosive solutions provided in tanks for plating metal parts. The problems encountered with the usage of such immersion heaters include the possibility of damaging the liner in the tank and associated equipment due to overheating if the level of the solution in the tank should happen to fall below the upper ends of the sheathed coils of the heater.

SUMMARY OF THE INVENTION

In accordance with the present invention, an electric immersion heater comprises a plurality of vertically disposed heater sheaths having the terminals of the leads of the coils therein extending up into a junction box from which the sheaths depend. The immersion heater is provided with a centrally disposed metal tube the top of which opens up into the junction box and the bottom of which contacts the metal support plate used to hold the heater sheaths in a spaced relation. The support plate is located at the level of the upper ends of the coils within the sheaths. A cylindrical cartridge encapsulating a thermal cutoff in the lower portion thereof has extending beyond the upper end thereof the terminal leads of the thermal cutoff which are twisted together and sufficiently long and stiff enough to enable the cartridge to be inserted and seated in the tube. The terminal leads of the coils in the heater sheaths and the thermal cutoff are joined in a circuit with the lines of the power supply by use of quick connectors located in the junction box. When the immersion heater is mounted on the side of a tank to heat the solution therein, in the event the level of the solution in the tank happens to fall below the upper ends of the coils in the heater sheaths, the thermal cutoff opens cutting off the power to the heater coils.

Accordingly, one of the objects of the present invention is to simply and inexpensively provide an electric immersion heater with a one shot thermal cutoff.

Another object of the present invention is to provide an electric immersion heater with a thermal cutoff that can be readily replaced when it has been opened by an overheated condition in the tank.

Another object of the present invention is to provide an electric immersion heater with a thermal cutoff that will open up when the level of the solution in a tank in which the immersion heater is mounted falls below the top of the sheathed heater coils thereof.

With these and other objects in view, the invention consists of the construction, arrangement, and combination of the various parts of the device wherey the objects contemplated are attained as hereinafter set forth, pointed out in the appended claims and illustrated in the accompanying drawings.

DESCRIPTION OF THE PREFERRED EMBODIMENT

Figure 1:
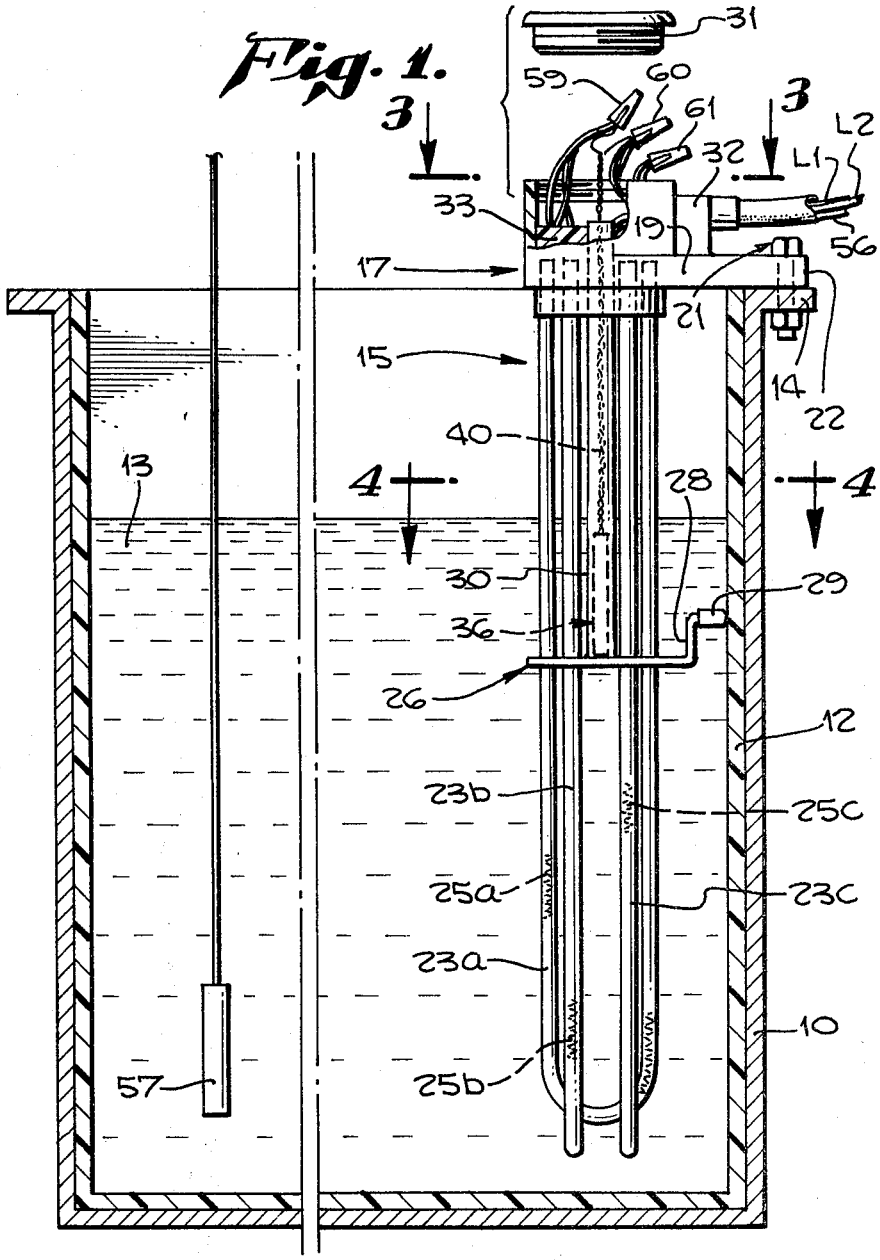
FIG. 1 illustrates a tank of solution having mounted on the side thereof an immersion heater including a thermal cutoff in accordance with the present invention.
Figure 4:
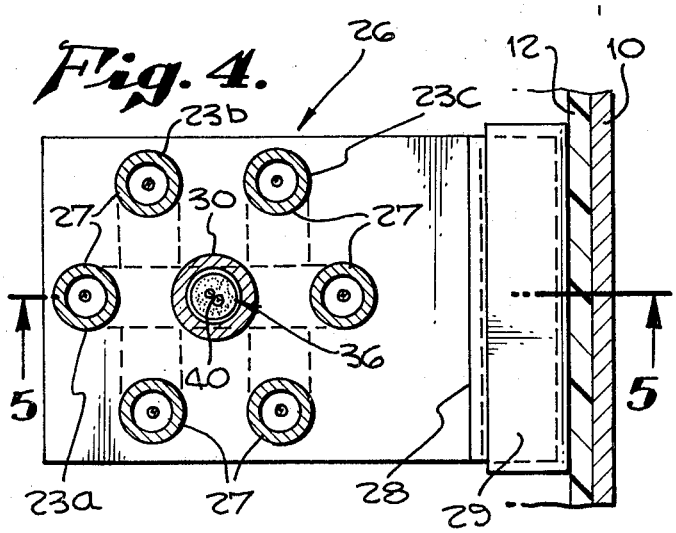
FIG. 4 is a sectional view taken along line 4—4 of FIG. 1.

Referring to the drawings, FIG. 1 illustrates a tank 10 having a plastic liner 12 therein. The tank 10 is filled with an caustic solution 13 to be used for plating metal parts. Mounted on the side of the tank 10 is an immersion heater 15 comprising a plastic molded junction box 17 having three U-shaped heater sheaths 23*a*, 23*b* and 23*c* depending therefrom. Each of the sheaths is formed of a length of inconel tubing. The vertical planes of the legs of two of the heater sheaths 23*b* and 23*c* are disposed in a spaced relationship parallel to each other while the vertical plane of the legs of the third heater sheath 23*a* is disposed in a spaced relationship normal to the vertical planes of and between the legs of the first two sheaths. Each of the heater sheaths 23*a*, 23*b* and 23*c* encloses a heater coil 25*a*, 25*b* and 25*c*, respectively. The upper ends of the legs of the sheaths 23*a*, 23*b* and 23*c* pass up through holes in the bottom of the junction box 17 so as to extend into the lower interior thereof.

A horizontally disposed metal support plate 26 is provided approximately midway of the length of the U-shaped sheaths 23*a*, 23*b* and 23*c*. The support plate is provided with six spaced openings 27 which receive the respective legs of the three U-shaped sheaths with a sliding fit and serve to hold the legs in a laterally spaced relationship. The support plate 26 has on one end thereof an upwardly bent vertical portion 28 with an outwardly projecting end portion 29 covered by a vinyl plastic.

Mounted on the support plate 26 so as to extend centrally of the legs of the U-shaped sheaths is a metal tube 30 which passes upwardly through a hole in the bottom of the junction box 17 so as to extend into the interior thereof. The bottom of the tube 30 is welded on the top of the support plate 26 to provide a fluid tight seal.

The junction box 17 of the immersion heater 15 is filled with a potting compound 33 so as to enclose the upper ends of the metal sheaths 23*a*, 23*b* and 23*c* while permitting the terminal leads of the coils 25*a*, 25*b* and 25*c* therein to extend upwardly beyond the compound. The open upper end of the tube 30 extends above the upper surface of the potting compound 33 so as to provide access to the interior thereof.

The junction box 17 has a boss 32 formed on the upper rear thereof with an opening for receiving terminals of voltage supply lines L1 and L2 and a ground line 56. The terminal of ground line 56 is soldered to the upper end of the tube 30. The junction box 17 also has an end support member 22 extending from the bottom rear thereof. The support member 22 has a pair of spaced openings 20 for bolt and nut combinations 21 by which the junction box 17 is mounted on a flange 14 provided on the top of the side wall of the tank. When the immersion heater 15 is so mounted, the vinyl covered projecting end portion 29 of the support plate 26 serves as a bumper which contacts the plastic liner 12 within the tank 10.

Figure 3:
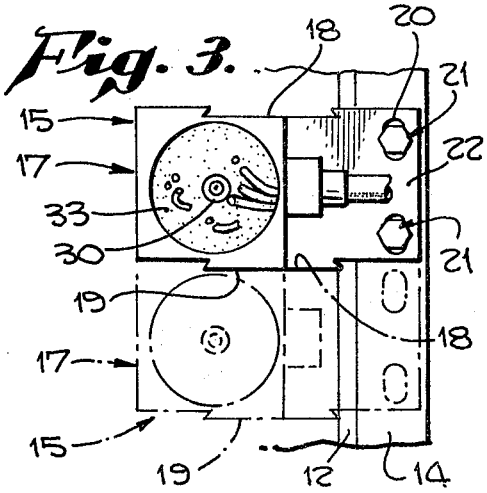
FIG. 3 is a view taken along line 3—3 of FIG. 1.

As shown in FIG. 3, one side face of the generally rectangularly shaped outer surface of the junction box 17 is provided with a dovetail recess 18 and the opposite side face is provided with a dovetail wedge 19. Such a structure enables the junction boxes 17 of adjacent immersion heaters 15 to be interlocked together, as illustrated in FIG. 3, when more than one immersion heater is needed to heat the solution in the tank.

Figure 2:
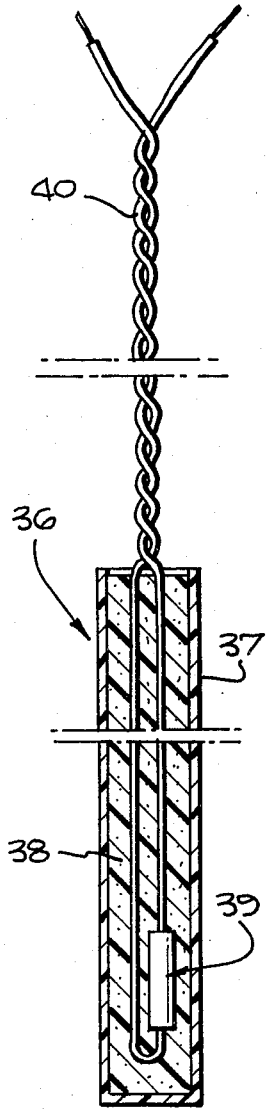
FIG. 2 shows a replaceable cartridge having encapsulated therein the thermal cutoff.
Figure 6:
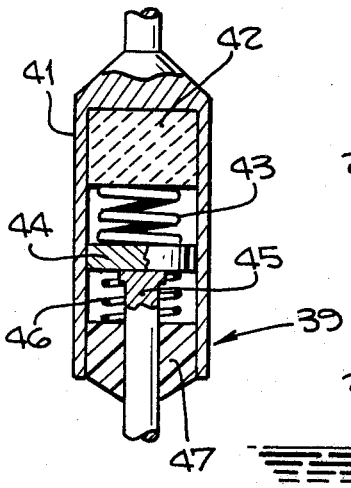
FIG. 6 is a sectional view of a typical thermal cutoff.

Referring to FIG. 2, next to be described is a cartridge 36 which encloses a thermal cutoff 39 and is adapted to be replaceably mounted within the tube 30 of the immersion heater 15. The cartridge 36 comprises an injection molded, thin-walled, tubular, plastic housing or potting cup 37 having the thermal cutoff 39 encapsulated in the lower portion thereof by use of a thermally conductive epoxy 38. The thermal cutoff 39 which is of the type commercially available under the trademark "MICROTEMP" comprises a cylindrical conductive metal casing 41, as shown in FIG. 6, enclosing a thermal pellet 42 in one end thereof. The pellet 42 together with a compressive spring 43 hold a movable contact 44 within the casing 42 against a fixed contact 45 which latter is located in the other end of casing 41 and insulated therefrom by an insulator 47. A trip spring 46 is located between the lower surface of the movable contact 44 and the upper surface of the insulator 47. The pellet 42 is made of an electrically non-conducting metal which melts at a predetermined temperature. Thus, at normal temperature, the movable contact 44 and the fixed contact 45 are held together forming a closed circuit. However, if the temperature should exceed the rating of the thermal cutoff 39, the pellet 42 melts enabling the trip spring 46 to move the movable contact 44 away from the fixed contact 45, thus opening the circuit. The thermal cutoff 39 is thus seen to have a one shot operation, after which it is discarded.

The portions of the terminal leads 40 of thermal cutoff 39 extending out of the tubular housing 37 are twisted together. These terminal leads 40 are sufficiently stiff and long enough so that upon applying a thermal grease such as aluminum filled silicone to the outer wall of the tubular housing 37, the cartridge 36 can be easily inserted into the upper end of the tube 30 and lowered so as to seat in the bottom thereof.

Figure 5:
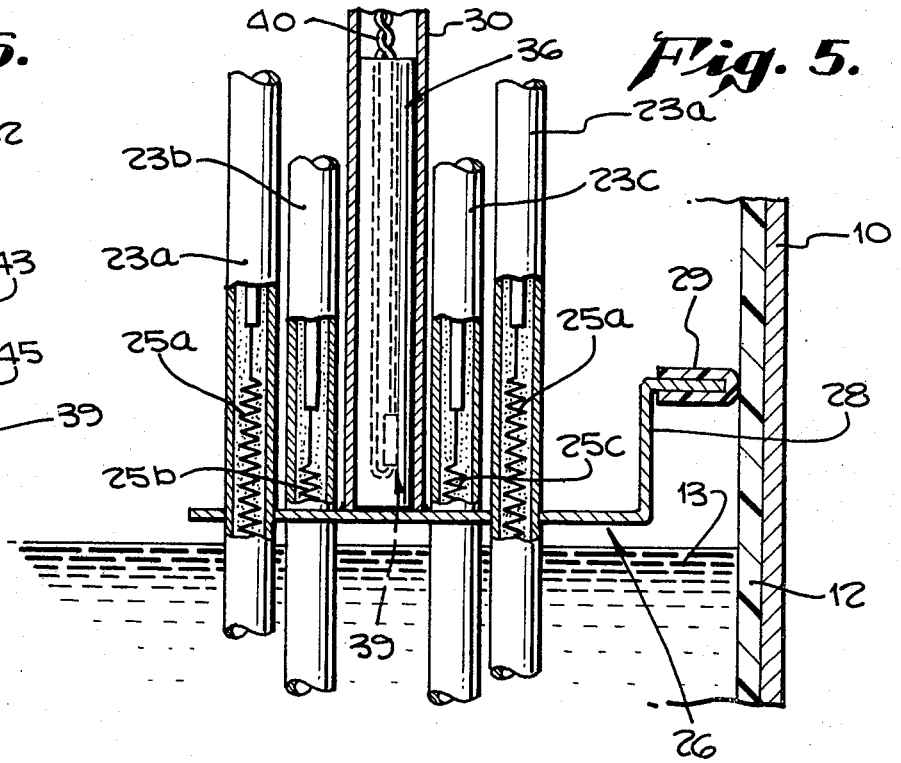
FIG. 5 is a sectional view taken along line 5—5 of FIG. 4.

The heater coils 25*a*, 25*b* and 25*c* are located within substantially the lower half length portions of the respective sheaths 23*a*, 23*b* and 23*c*. In particular, as shown in FIG. 5, the upper ends of the coil 25*a* in the legs of the U-shaped sheath 23*a* are located at approximately the level of the vinyl covered projection portion of the support plate 26 while the upper ends of the coils 25*b* and 25*c* enclosed within the legs of the two other U-shaped sheaths 23*b* and 23*c* are located a little lower, as illustrated in FIG. 1, because the sheaths are lower.

Figure 7:
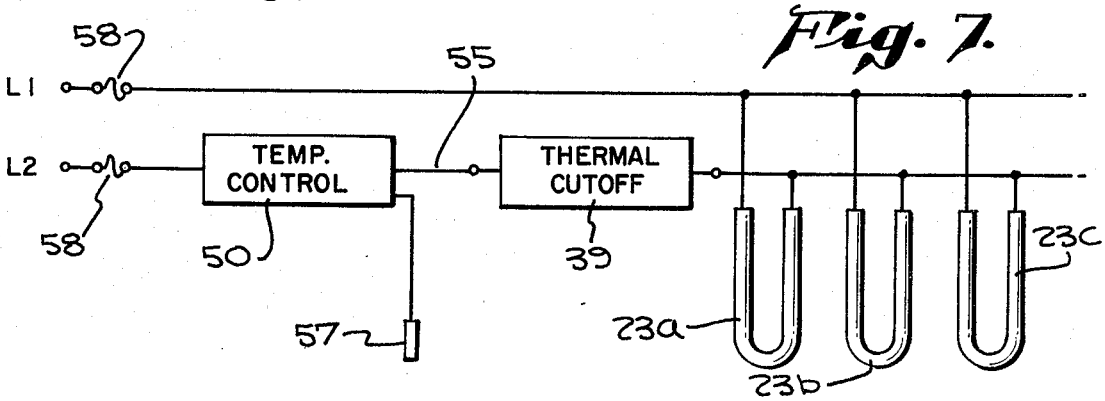
FIG. 7 is a schematic diagram of a single phase electrical supply circuit for the immersion heater with thermal cutoff.

A schematic circuit diagram of the electrical connections of the terminals of the coils 25*a*, 25*b* and 25*c* of the immersion heater 15 and the terminals of the thermal cutoff 39 to the lines L1 and L2 of the single phase 240 volt A.C. supply voltage are shown in FIG. 7. One of the terminal leads of each of the coils 25*a*, 25*b* and 25*c* in the three heater sheaths 23*a*, 23*b* and 23*c* are connected to the power line L1. The other of the terminal leads of each of the coils 25*a*, 25*b* and 25*c* together with the terminal lead on one end of the thermal cutoff 39 are connected together. Then, the terminal lead on the other end of the thermal cutoff 39 is joined with the terminal portion 55 of the other power line L2, the other end of which is connected to a temperature control 50. The junctions of the terminal leads of the heater coils 25*a*, 25*b* and 25*c* in the respective sheaths 23*a*, 23*b* and 23*c*, the terminal leads of the terminal cutoff 39, and the terminals of the lines L1 and L2, as shown in FIG. 7, are made by quick connectors 59, 60 and 61. These quick connectors (FIG. 1) are then pushed down into the upper portion of the junction box which is then closed off by use of the threaded cap 31. The temperature control 50 is provided with a temperature probe 57 which is inserted into the solution of the tank 10. The probe 57 senses the temperature of the solution and opens or closes a contact (not shown) within the temperature control 50 to supply power to the coils 25*a*, 25*b* and 25*c* to maintain the temperature of the solution 13 to that set by the temperature control 50. Fuses 58 are provided, as shown, in each of the lines L1 and L2. The fuses are selected to blow at a current which is just below the temperature rating of the thermal cutoff 39.

It should now be clear, as illustrated in FIG. 1, that normally when the immersion heater 15 is supplied with power, the level of the solution 13 in the tank 10 is well above the support plate 26 and, therefore, the upper ends of the heater coils 25*a*, 25*b* and 25*c*. Thus, the solution surrounding the heater coils cools the support plate 26 and tube 30 together with the thermal cutoff 39 and protects the liner 12 on the wall of the tank 10 opposite the immersion heater 15 from being overheated. However, if the level of the solution should happen to drop to a level below the top of the heater coils 25*a*, 25*b* and 25*c*, as shown in FIG. 5, the heat generated by these coils, if permitted to continue, would seriously damage the liner 12 in the tank 10. Thus, in accordance with the present invention, when the level of the solution drops below the top of the coils 25*a*, 25*b* and 25*c* of the immersion heater, the metal support plate 26, being in contact with the heater sheaths, is heated by the heat generated therein. This heat is transmitted to the metal central tube 30 which, in turn, conducts through the thermally conductive epoxy 38 and heats the thermal cutoff 39, causing its pellet 42 to melt and thereby open the circuit in which it is inserted, thus cutting off power to the heater coils 25*a*, 25*b* and 25*c*. The thermal cutoff 39 may be selected such that its pellet 42 melts at a temperature of 225 degrees F., for example.

Note that the vinyl covered bumper 29 on the support plate 26 serves as a level indicator to let the operator know the safe level of the solution in the tank 10 which assures that the thermal cutoff 39 will not be opened. Furthermore, the surface of the vertical portion 28 of the support plate 26 serves to reflect heat and therefore prevents the liner 12 of the tank in the vicinity from being directly exposed to the heat of the heater coils when the level of the solution starts to fall below the safe level.

It should now be clearly understood that whenever the thermal cutoff 39 opens the power supply circuit, due to an overheating in the tank 10 caused by the lowering of the solution 13, the cap 31 on the junction box 17 can be removed to gain access to the quick connectors 59, 60 and 61. The quick connectors 59 and 60 joining the terminal leads 40 of the thermal cutoff 39, as described in connection with FIG. 7, are then removed so as to free the cartridge 36 so that it can be withdrawn from the tube 30. The housing 37 of the new cartridge 36 is preferably covered with an alumina filled silicone grease to facilitate heat transfer into the tube 30. The terminal leads 40 of the new cartridge 36 are then joined to the appropriate junctions by use of the quick connectors 59 and 60.

Figure 8:
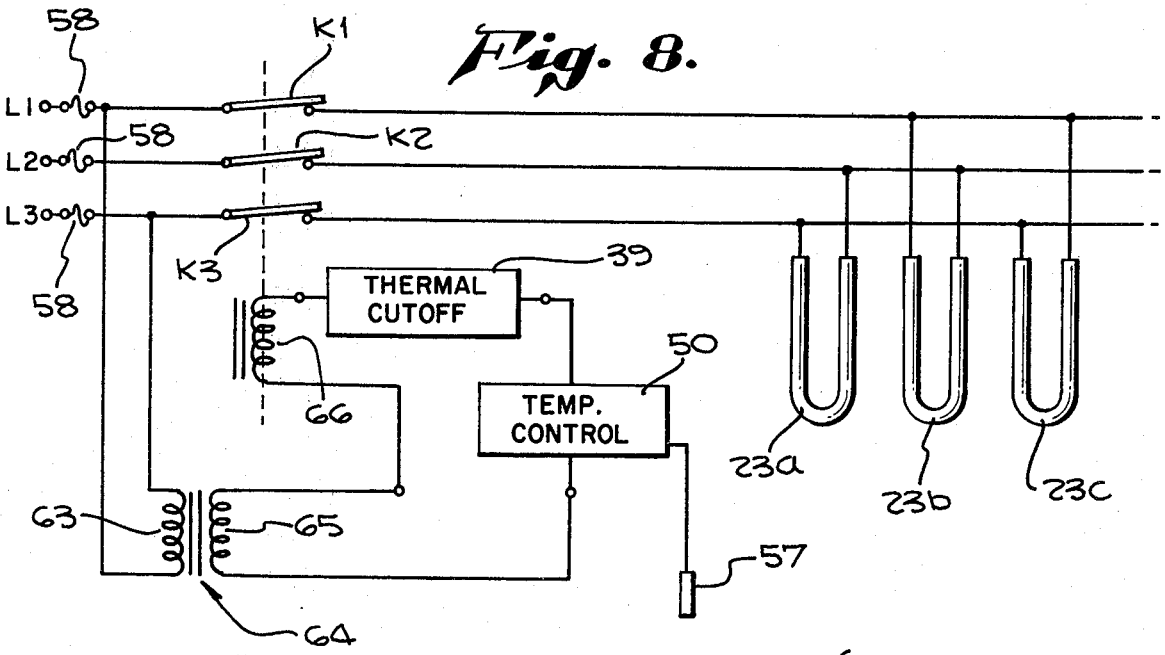
FIG. 8 is a schematic diagram of a three phase electrical supply circuit for the immersion heater with thermal cutoff.

FIG. 8 is a schematic diagram of a modified electrical circuit showing how the terminal leads of the respective coils 25*a*, 25*b* and 25*c* in the heater sheaths 23*a*, 23*b* and 23*c* and the terminal leads 40 of the thermal cutoff 39 can be connected to the terminals of power lines L1, L2 and L3 when a three phase 480 volt A.C. supply voltage is used with the immersion heater 15. These junctions are made by use of quick connectors, as previously described. Thus, the terminal leads on one of the ends of the coils 25*b* and 25*c* are joined to line L1, the terminal leads on one of the ends of coil 25*a* and the other end of coil 25*b* are joined to the line L2, and the terminal leads on the other ends of the coils 25*a* and 25*c* are joined to line L3. The lines L1, L2, and L3 include therein three contactors K1, K2, K3, respectively. The power from lines L1 and L3 is supplied across the primary winding 63 of a transformer 64, the secondary winding 65 of which is connected across a series circuit comprising the contactor coil 66, the thermal cutoff 39 and the temperature control 50. The temperature probe 57 in the solution 30 of the tank is connected to the temperature control 50.

It should be understood that by use of the circuit in FIG. 8, when the power is on to heat the solution in the tank by use of the immersion heater 15, the output of the secondary winding 65 of the transformer 64 energizes the contactor coil 66 connected in series with the thermal cutoff 39 and the temperature control 50 to keep contacts K1, K2 and K3 closed. During the normal operation of the tank, the probe 57 senses the temperature of the solution 14 and opens and closes a contact in the temperature control 50 to maintain the solution at a set temperature. If the level of the solution in the tank 10 should happen to fall at any time to a level, shown in FIG. 5, exposing the upper ends of the heater coils 25*a*, 25*b* and 25*c*, the heat generated by these coils is radiated and conducted by the support plate 26 to the central tube 30 and through the thermally conducting epoxy 38 to heat the thermal cutoff 39. This causes the pellet 42 in the thermal cutoff to melt, opening the circuit and deenergizing the contactor coil 66 to open the contacts K1, K2 and K3. The thermal cutoff 39 thus acts to remove power from the immersion heater 15 and requires that the level of the solution in the tank be raised above the vinyl covered bumper 29 of the support plate 26 and the cartridge 36 replaced before the operation of the tank can be restarted. Fuses 58 are inserted in each of the lines L1, L2, and L3 to protect the immersion heater and the thermal cutoff from drawing excess current in case of a short, for example.

While the invention shown and described herein has been well adapted to fulfill the objects and advantages previously mentioned as desirable, it is to be understood that the invention is not limited to the specific features shown and described but that the means and configuration herein disclosed are susceptible of modification in form, proportion and arrangement of parts without departing from the principle involved for sacrificing any of its advantages and the invention is therefore claimed in embodiments of various forms all coming within the scope of the claims which follow.

What is claimed is:

1. An immersion heater for heating a liquid in a tank having a plastic liner on the inner walls thereof, said immersion heater comprising:

a junction box having an extension thereon for mounting on the side of a tank;

a plurality of elongated heater sheaths depending from the bottom of said box, said sheaths having heater coils therein with terminal leads extending up into said junction box; the top end of said coil is spaced below the bottom of said junction box;

a transversely disposed metallic support plate located in the vicinity of the top of the coils in the sheaths and having spaced openings through which said sheaths pass, said support plate having on the end thereof an upright heat reflecting surface with a terminating bumper for contacting the side wall of the tank;

a metallic tube having the bottom thereon attached to the surface of said support plate centrally of said sheaths, said tube extending upwardly into said junction box;

a thermal cutoff removably inserted into the lower portion of said tube and having thermal leads extending upwardly into said junction box; and quick connectors for connecting the terminal leads of said thermal cutoff in a circuit with other terminal leads in said junction box;

whereby when a liquid level in the tank drops to expose the upper ends of the heater coils in the sheaths the heat generated by the upper ends of the heater coils opens the thermal cutoff and breaks the circuit to thereby protect a plastic liner on the side wall of the tank adjacent the immersion heater.

2. The immersion heater in accordance with claim 1 wherein said heater sheaths are U-shaped.

3. The immersion heater in accordance with claim 1 wherein said terminating bumper portion of said support plate is located at substantially the level of the upper ends of the coils in the sheaths.

4. The immersion heater in accordance with claim 1 wherein said thermal cutoff is encapsulated in a cartridge which is insertable into said tube.

5. The immersion heater in accordance with claim 4 wherein said cartridge comprises:

a molded cylindrical plastic housing of a size to have a sliding fit within said tube;

said housing having a thermally conductive epoxy encapsulating said thermal cutoff; and wherein a thermally conductive grease is applied over the surface of said housing to aid in the insertion thereof into said tube.

6. The immersion heater in accordance with claim 2 wherein the terminals of two power lines extend into said junction box;

wherein the terminals of the coils in one leg of each of said U-shaped sheaves are connected to the terminal of one of said power lines;

wherein the terminals of the coils in the other leg of each of said U-shaped heater sheaves are connected to one terminal of said thermal cutoff by a quick connector; and wherein the other terminal of said thermal cutoff is connected to the terminal of the other of said power lines by a quick connector.

7. The immersion heater in accordance with claim 1 wherein said thermal cutoff includes a thermal pellet which melts to open the circuit when the temperature reaches a predetermined value.

8. An electric immersion heater for heating a solution in a tank having a plastic liner on the inner walls thereof, said immersing heater comprising:

a junction box having an extension thereon for mounting on the side of a tank;

three spaced U-shaped heater sheaths having the legs thereof depending from said junction box, each said sheath having a heater coil therein with terminal leads extending upwardly in the legs thereof into said junction box; the top end of said coil is spaced below the bottom of said junction box;

a transversely disposed metal support plate having spaced holes for receiving the legs of said heater sheaths and holding them in spaced relationship, said support plate located in the vicinity of the top ends of the heater coils in said sheaths; said support plate having on the end thereof an upright heat reflecting surface with a terminating bumper for contacting the side wall of the tank;

a metal tube centrally disposed with respect to the legs of said heater sheaths with its bottom attached to said support plate and its top extending upwardly into said junction box; and a cartridge including:

an injection molded plastic thin-walled cylindrical housing of a size to have a sliding fit within said tube;

a one-shot thermal cutoff encapsulated by use of a thermally conductive epoxy in the bottom portion of said cylindrical housing and having its terminal leads extending above the top of said housing twisted together; and a thermally conductive grease on the outer wall of said cylindrical housing;

said twisted together end terminal leads of said thermal cutoff being sufficiently stiff and long enough to enable said cartridge to be readily inserted into and removed from a seat within said tube.

9. An immersion heater for heating a liquid in a tank having a plastic liner on the inner walls thereof, said immersion heater comprising:

a junction box having an extension thereon for mounting on the side of a tank;

at least one elongated sheath depending from the bottom of said junction box, said sheath having a heater coil disposed therein with its terminal leads extending into said junction box; the top end of said coil is spaced below the bottom of said junction box;

a transversely disposed support plate located in the vicinity of the top of the coil in the sheath and having an opening through which the sheath passes, said support plate having on the end thereof an upright heat barrier with a terminating bumper for contacting the side wall of the tank;

a tube disposed adjacent to but spaced from said sheath, said tube having a closed bottom located at substantially the level of the upper end of the heater coil in said sheath and having an open top located at substantially the level of said junction box, the normal level of a liquid in said tank providing for covering the upper end of the heater coil in said sheath;

a cartridge including an elongated molded thin-walled cylindrical housing having a close fit within said tube, said housing having a thermal cutoff encapsulated by use of a thermally conductive epoxy in the lower portion thereof with its terminal leads extending out of the top of said housing twisted together and sufficiently stiff and long enough to enable said housing to be removably inserted and seated in the bottom of said tube with the upper ends of said terminal leads extending into said junction box; and quick connectors in said junction box for connecting the terminal leads of said thermal cutoff and said coil in a circuit arrangement with a source of electrical energy;

whereby when the liquid level in the tank drops so that the upper end of the heater coil in the sheath is out of the liquid the heat generated by the upper end of the heater coil opens the thermal cutoff in said housing and breaks the circuit arrangement to thereby protect a plastic liner on the side wall of the tank adjacent the immersion heater.

* * * * *